US005907984A

United States Patent [19]

Herman, Jr. et al.

[11] Patent Number: 5,907,984

[45] Date of Patent: Jun. 1, 1999

[54] PARALLEL CUTTING ASSEMBLY FOR CUTTING SHEET MATERIAL

[75] Inventors: James S. Herman, Jr.; Marvin H. Duncan, Jr., both of Marblehead, Mass.

[73] Assignee: Cutting Edge Inc., Mablehead, Mass.

[21] Appl. No.: 08/425,952

[22] Filed: Apr. 19, 1995

[51] Int. Cl.[6] ..... B26D 1/18; B26D 7/01

[52] U.S. Cl. ..... 83/24; 83/34; 83/39; 83/100; 83/425.3; 83/483; 83/495

[58] Field of Search ..... 83/941, 100, 155, 83/24, 56, 34, 49, 451, 331, 498, 495, 152, 487, 425.3, 483, 39

[56] References Cited

U.S. PATENT DOCUMENTS

| | | | |
|---|---|---|---|
| 2,293,178 | 8/1942 | Stocker . | |
| 3,495,492 | 2/1970 | Gerber et al. . | |
| 3,511,124 | 5/1970 | Bruns | 83/527 X |
| 3,710,662 | 1/1973 | Olday . | |
| 3,750,513 | 8/1973 | Cromeens . | |
| 3,772,949 | 11/1973 | Pavone et al. . | |
| 3,776,072 | 12/1973 | Gerber et al. . | |
| 3,776,074 | 12/1973 | Pearl et al. . | |
| 3,777,604 | 12/1973 | Gerber . | |
| 3,828,633 | 8/1974 | Klingen | 83/56 |
| 3,855,887 | 12/1974 | Pearl et al. . | |
| 3,864,997 | 2/1975 | Pearl et al. . | |
| 3,875,389 | 4/1975 | McFadden et al. . | |
| 3,918,335 | 11/1975 | Warnock et al. . | |
| 4,091,701 | 5/1978 | Pearl . | |
| 4,362,077 | 12/1982 | Gerber . | |
| 4,373,412 | 2/1983 | Gerber et al. | 83/451 |
| 4,444,078 | 4/1984 | Pearl . | |
| 4,462,292 | 7/1984 | Pearl . | |
| 4,476,756 | 10/1984 | Pearl et al. . | |
| 4,540,394 | 9/1985 | Cavagna . | |
| 4,592,259 | 6/1986 | Gorner et al. . | |
| 4,593,589 | 6/1986 | Gherardi | 83/487 |
| 4,649,782 | 3/1987 | Cavagna . | |
| 4,691,749 | 9/1987 | Reuter . | |
| 4,762,040 | 8/1988 | Alcantara Perez et al. . | |
| 4,863,322 | 9/1989 | Kirchberger et al. . | |
| 5,125,301 | 6/1992 | Miller et al. . | |
| 5,214,590 | 5/1993 | Schnetzer | 83/49 |
| 5,234,549 | 8/1993 | Weldon . | |

FOREIGN PATENT DOCUMENTS

| | | | |
|---|---|---|---|
| 102413 | 8/1981 | Japan | 83/425.3 |

*Primary Examiner*—Rinaldi I. Rada
*Assistant Examiner*—Charles Goodman
*Attorney, Agent, or Firm*—Cumpston & Shaw

[57] ABSTRACT

A method and apparatus for cutting sheet material upon an apertured support surface, the apparatus including a pair of spaced apart parallel cutters. The cutters are spaced apart by a distance greater than a dimension of the apertures, but less than an inter aperture distance so that at least one of the cutters remains in cutting contact with the support surface when the remaining cutter passes over an aperture. The method includes selectively overcutting and undercutting the line segments at an intersection to ensure continuity of cut paths of both cutters.

16 Claims, 3 Drawing Sheets

PARALLEL CUTTING ASSEMBLY FOR CUTTING SHEET MATERIAL

FIELD OF THE INVENTION

The present invention relates to cutting sheet material, and more particularly, to a cutting assembly having parallel cutters for cutting sheet material retained upon a vacuum table having a plurality of vacuum apertures.

BACKGROUND OF THE INVENTION

Rotary wheel cutters, in contrast to reciprocating blade cutters, have unique characteristics which are suitable for cutting plies of sheet material that are collectively relatively thin, for example, less than ¼ inch thickness. The cutting action produced by a wheel comes about through a severance of the material when the sharp peripheral cutting edge of the wheel is brought into engagement with a support surface with the material therebetween. The edge severs the materials or fibers in what is believed to be both a crushing and cutting operation. A unique and advantageous characteristic of the rotary wheel cutting process is that there is basically no inherent limitation on the speed at which the severance of material takes place, nor upon the rate at which the cutting wheel operates producing that severing process. Consequently, a cutting wheel is a desirable tool for cutting a single ply of selected fabric material, for example, a suit.

One of the principle difficulties encountered in cutting single plies of sheet material is the retention of the sheet material in a fixed position throughout the cutting process. In systems employing an automatically controlled machine that operates from a predetermined program, the material cannot shift in the course of a cutting operation, otherwise, the pattern pieces that are cut will not conform to the program lines of cut. Also, since high speed is one of the main advantages of the cutting wheel, the machine should be designed to perform at high speed with minimum inertia and extra motion.

Vacuum hold down devices of the type which produce sub atmospheric pressure at a work or bearing surface on which the sheet material is spread have gained acceptance in the material cutting art. A vacuum hold down device is disclosed in U.S. Pat. No. 4,444,078. The vacuum hold down device includes a cutting wheel which rolls in cutting engagement with a bearing surface which has an array of openings therethrough communicating through channels with a vacuum pump. However, problems may be encountered when such apparatus is used to cut materials such woven fabrics. As the cutting instrument passes over the apertures in the bearing surface, threads which comprise the fabric may be forced into the apertures by the cutting instrument rather than being cut by it. As a result, pattern pieces cut from the fabric are not easily separated from the waste material. Further, failure to effectively sheer of all the threads which comprise the fabric in the area of an aperture may result in cut pattern pieces with rough or ragged edges.

U.S. Pat. No. 4,444,078 represents an approach of the prior art to solve the present problem. In the '078 apparatus, each aperture in the support surface includes a valve movable between an open position spaced from the support surface and closed position flush with the adjacent support surface. A support surface having a multitude of these valves and associated mechanisms for selectively activating the valves is extremely complex and hence expensive. Further, the large number of moving parts increases maintenance requirements.

Therefore, the need exists for a cutting system which cooperates with an apertured vacuum support surface to substantially separate the sheet material along a predetermined line. The need further exists for a method of cutting sheet material on an apertured vacuum support surface which reduces bridges of material between a desired part periphery and the remaining portion of the sheet. The need further exists for a cutting system that can be employed in existing vacuum systems for improving the performance of the system.

SUMMARY OF THE INVENTION

The present invention includes a cutting apparatus for cooperative engagement with a vacuum support surface having a plurality of vacuum apertures. The cutting apparatus includes a pair of parallel spaced apart cutters separated by a distance greater than a dimension of the individual vacuum apertures, but less than the spacing between adjacent vacuum apertures. An inner cutter is directed by a controller to trace the periphery of the desired part. An adjacent outer cutter forms a parallel cut just outside the desired piece periphery. In the areas of the part periphery that over lie a vacuum aperture, cutting of the sheet material by the inner cutter may not be insured. The parallel outer cutter is spaced so that upon the inner cutter passing over an aperture, the outer cutter is urged against the support surface and the sheet material is locally cut by the outer cutter.

The resulting cut produces a pair of parallel cuts around a part periphery, wherein local bridges of material may exist having a dimension substantially equal to the distance between the parallel cutters. Upon the weeding operation, the local bridges of material easily fracture producing a sufficiently smooth and continuous part periphery.

DETAILED DESCRIPTION OF THE PREFERRED EMBODIMENTS

Figure 1:
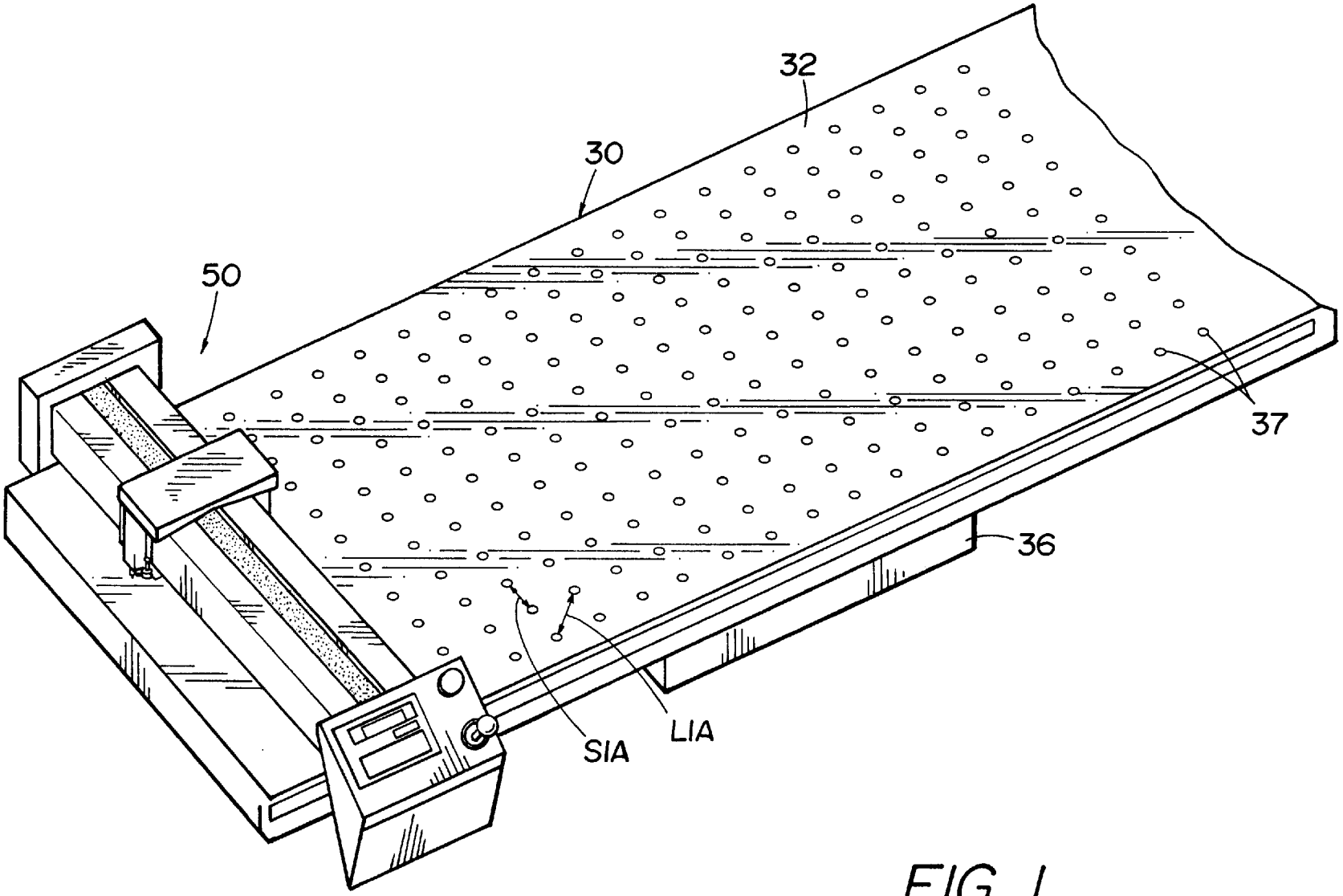
FIG. 1 is a perspective view of an apertured support surface cutting system.

A cutting system embodying the present invention is shown in FIG. 1. The apparatus is particularly adapted for cutting a single sheet of material or a lay up comprising relatively few sheets of material arranged in a stacked relation. The cutting system generally includes a vacuum table assembly 30, a carriage assembly 50, and a controller.

Vacuum Table Assembly

Figure 2:
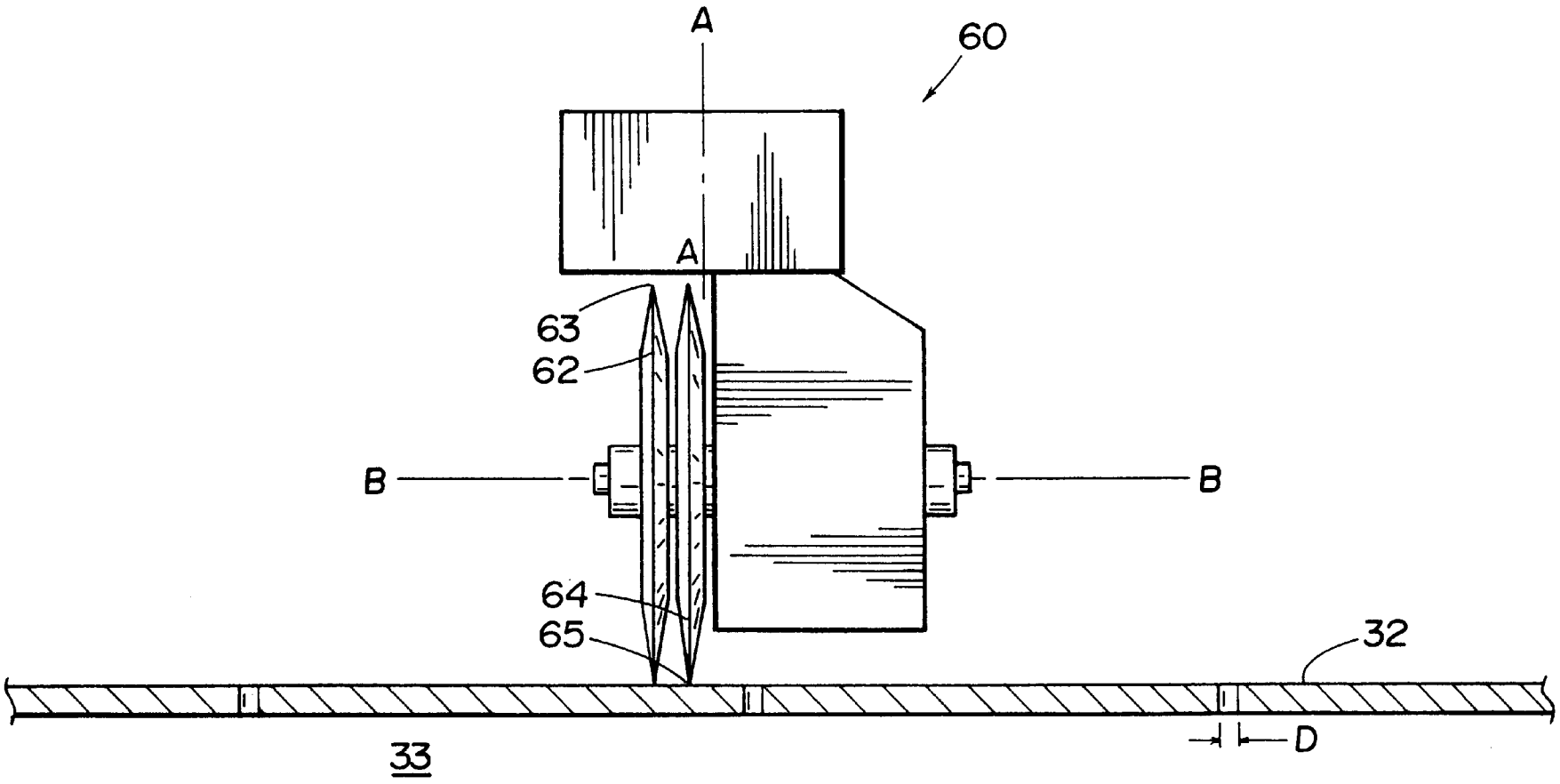
FIG. 2 is a partial cut away elevation view of the support surface with the present parallel cutter.

Referring to FIGS. 1 and 2, the vacuum table assembly 30 provides a support surface 32 for a work piece or lay up which includes layer(s) of sheet material arranged in a face to face or a face up vertically stacked relation. The vacuum table assembly 30 has a horizontally disposed generally rectangular base which supports an upper plate 34 and lower a plate respectively joined together by longitudinally extending side members and transversely extending end members defining a vacuum chamber 33. A vacuum is applied to the vacuum chamber 33 through a duct which communicates with the chamber and is connected to a suitable vacuum generator 36. Preferably, the generator 36 has a high flow rate capacity. The upper plate 34 includes a plurality of passageways 35 which communicate with the chamber 33 and open through an upper surface at a plurality of corresponding apertures 37. The upper surface of the plate 34 may serve as the support surface for the sheet material.

The upper plate 34 may be formed out of any of a variety of materials such as metal, plastics or composites. In addition, the upper plate 34 may include an apertured replaceable wear layer which forms the support surface 32.

Alternatively, the upper plate 34 and support surface 32 may be a slightly penetrable plastic substrate having a plurality of apertures 37. Although the apertures 37 or opening of each passageway 35 are shown as circular, it is understood that the apertures may be any of a variety of shapes such as triangular, square, rectangular or polygonal. In addition, the apertures may have a cylindrical, tapered or frustoconical cross section. In each case, the aperture 37 has a maximum dimension D, which for the circular aperture is the diameter of the aperture.

The apertures 37 are located in the support surface 32 in a pattern. A common alignment is in a regular repeating array of rows and columns. Therefore, the apertures 37 are separated by a short inter aperture spacing SIA (between adjacent apertures in a given row or column) and a long inter aperture spacing LIA (between apertures on a diagonal between two rows or columns. As the short inter aperture spacing defines the minimum distance between adjacent apertures, the term "inter aperture" spacing may be taken as the short or smallest inter aperture spacing. Preferably, the aperture dimension D is less than the inter aperture spacing.

Carriage Assembly

The carriage assembly 50 is supported on the table assembly 30 to move the cutter assembly 60 in the longitudinal (x) and transverse (y) coordinate directions relative to the support surface 32 in response to signals received from the controller, in a manner well known in the art. The cutting assembly 60 is connected to the carriage assembly for angular movement about a pivot axis A-A generally perpendicular to the support surface 32 in response to control signals from the controller. The carriage assembly 50 may include a plunger or bias mechanism such as a hydraulic piston, cam or spring for urging the cutting assembly 60 towards the support surface 32, Thus, the cutting assembly 60 is arranged for rolling engagement against the support surface 32 to cut pattern pieces from the sheet material.

Cutting Assembly

As shown in FIG. 2, the cutting assembly 60 includes a pair of spaced apart peripheral cutting wheels 62, 64 having corresponding cutting edges 63, 65 discs or wheels which penetrate any overlay sheet and the sheet material. Depending upon the configuration of the system, the cutting edges 63, 65 may penetrate the support surface 32 when the sheet material is cut. As previously stated, the cutting assembly 60 is mounted so that the assembly can be rotated about the pivot axis A—A.

The cutting wheels 62, 64 have an axis of rotation BB about which the wheels rotate and the peripheral cutting edge 63, 65 circumscribes the axis of rotation BB in a plane normal to the axis of rotation. The axis of rotation BB of the cutting wheels 62, 64 may be rotated about the pivot axis AA so that the cutting wheels may track against the support surface 32 in any direction within the plane of the support surface.

In addition, pivot axis AA is non intersectingly aligned with axis of rotation BB. That is, during cutting engagement with the support surface 32, the pivot axis AA leads the translation of the axis of rotation BB as the cutting wheels 62, 64 traverse a cutting path along the support surface 32.

Figure 3:
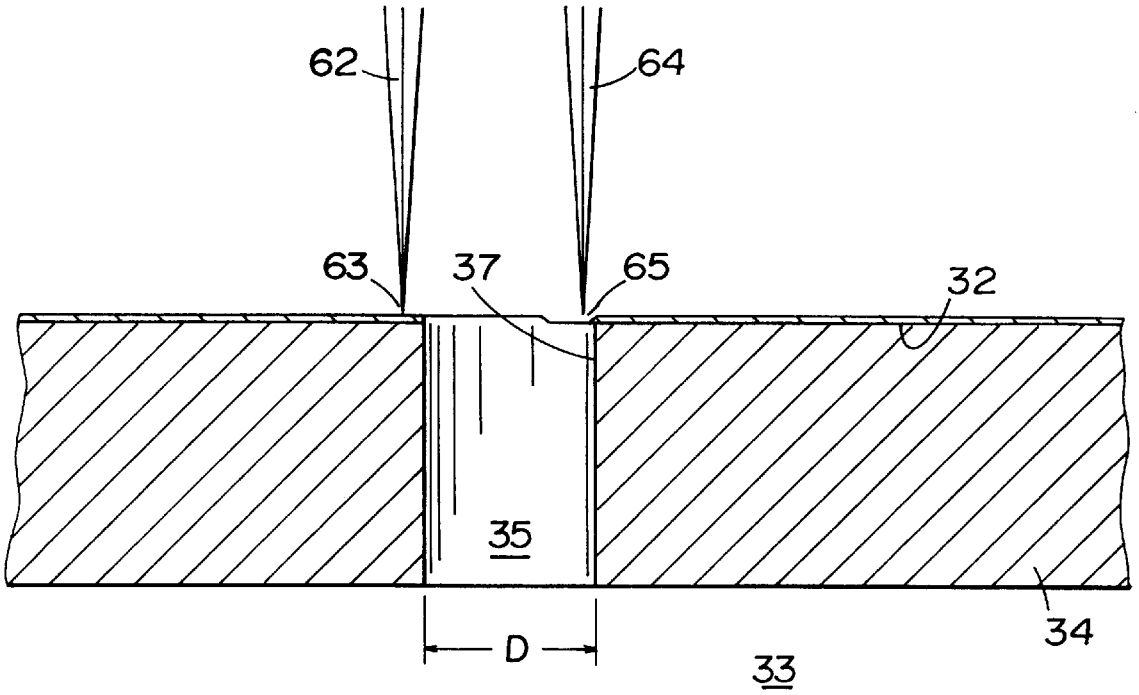
FIG. 3 is an enlarged view showing the parallel cutter passing over an aperture.

Referring to FIGS. 2 and 3, the parallel wheels 62, 64 are separated by a distance which is substantially equal to or only slightly greater than the aperture dimension D, so that upon passage of one wheel over an aperture 37 (where the material may not be cut), the remaining wheel is urged against the support surface 32 to cut the material therebetween.

The spacing between the parallel wheels 62, 64 is generally determined by size of the apertures 37 in the support surface 32. The spacing between the wheels 62, 64 may be set from approximately the dimension of the apertures 37 to the short, or long inter-aperture distance. That is, the spacing between the blades 633, 65 may range from approximately 50% to 200% of the aperture dimension D with a preferable range of between 80% to 110%. To minimize the amount of material necessary to perform the parallel cuts, the parallel cutters 62, 64 are spaced by a distance as near the aperture dimension D as possible to ensure local cutting of the material by one of the parallel cutters upon a desired cut path intersecting an aperture 37. While this dimension may be in part determined by the type of material being cut, contact of at least one wheel with the support surface 32 for all locations of the cutting assembly 60 against the support surface ensures complete cutting.

In addition, spacing between the parallel cutters 62, 64 may be particularly determined by the material to be cut. That is, for very pliable or soft material there must be contact between a solid portion of the support surface 32 and the cutter. Therefore, the cutter spacing will be at least slightly greater than 100% of the aperture dimension D.

However, for coarser or more rigid material, the wheel spacing may be slightly less than the aperture dimension D, as the material exhibits sufficient rigidity to be severed even though a small portion the cut line over lies an aperture. As the aperture dimension D may be on the order of approximately 1/16 inch, the distance separating the parallel discs or cutters may be approximately 1/32 and 5/64 of an inch.

Controller

The controller is a standard desk top computer such as an IBM, compatible or Macintosh. The controller includes a user interface for entering instructions as to the sheet material and patterns to be cut.

A cutting program runs in the controller for directing the orientation of the cutting assembly relative to the desired periphery. The cutting program may designate which cutting wheel 62, 64 follows or traces the desired cut path as the inner wheel and which cutting wheel is outside the desired pattern as the outer wheel. The cutting program includes instructions for directing the inner wheel along the desired cut path and maintains the axis of rotation BB perpendicular to any radius of curvation in the cut path. In order for sufficient borders or tolerances to exist, a nesting program may adjust the nest to allow for certain cuts.

Figure 4:
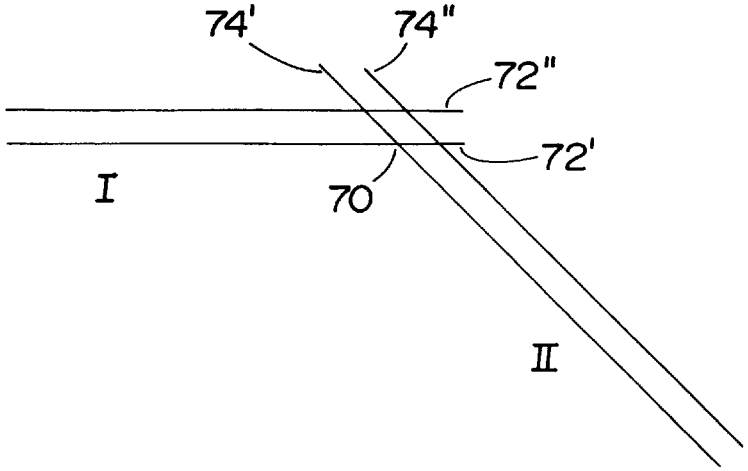
FIG. 4 is a top plan view of the cutting of an apex in a part periphery.

As shown in FIG. 4, to ensure as complete separation as possible along the cut path, the cutting program causes a specific overlap of cut segments at non-radiussed curves or apexes 70 in the part periphery. The cutting program employs overcuts 72 (cuts beyond the apex at the terminal end of a path segment) and heel cuts 74 (cuts before the cut path reaches the next path segment at the apex) to insure a severance of the material. Specifically, the parallel cutter overcuts or heel cuts a sufficient distance at the apex 70 so that the lines cut by the inner and the outer cutter along a first segment I (including any overcut) intersect both the lines cut by the inner and outer cutter along a second segment 11 (including any heel cut).

Referring to FIG. 4 for intersecting segments of the cut path forming an apex 70 or the intersection of two path segments I, II, the cutting program causes the inner wheel to severe the sheet material beyond the apex 70 when cutting the first segment I by a distance sufficient to ensure that upon initiating travel of the inner wheel along the second segment II, the inner wheel path intersects both the inner wheel path and the outer wheel path of the first segment I.

When cutting an apex 70, or intersection of two path segments, the cutting program drives the inner cutting wheel beyond the apex by an inner overcut 72'. As the inner cutting wheel is translated along the inner overcut 72', the outer cutting wheel is correspondingly translated along an outer overcut 72".

The cutting wheels 62, 64 are then lifted out of cutting engagement with the support surface 32 and rotated about the pivot axis AA. The axis of rotation BB is translated about the pivot axis AA to dispose the cutting wheels 62, 64 relative to the apex 70 such that upon lowering the cutting wheels into cutting engagement with the support surface 32 to translate the inner cutting wheel along the second path segment II, the inner wheel intersects the inner overcut 72' and the outer overcut 72", and the outer wheel intersects the inner overcut 72' and the outer overcut 72". Therefore, as the cutting wheels 62, 64 are translated about the part periphery, the path traced by the inner cutting wheel and outer cutting wheel is uninterrupted.

At any apex 70 for each path segment forming the apex, the inner cutter path intersects the inner and outer cut path of the remaining segment. Similarly, for each path segment forming the apex 70, the outer cut path intersects the inner and outer cut path of the remaining segment.

Cutting the part periphery with this scheme on an apertured table forms a cut path on the part periphery and a parallel cut path outside the part periphery by a distance equal to the spacing between the parallel wheels.

Therefore, the largest bridge of uncut material has a length of the aperture dimension D and a width of the spacing between the parallel cutting wheels 62, 64. Although a single cutting wheel would also form a material bridge having a length of the aperture dimension D along the cut path, the present parallel cutting wheel defines a width of the bridge, thereby enhancing separation of the cut part from the sheet material.

Operation

When the marker is generated for cutting the sheet material, a sufficient border is created between adjacent pieces so that the outer wheel will not intersect the periphery of an adjacent piece.

That is, the inner cutter is set to sever the sheet material along the desired periphery. The outer cutter cuts a periphery approximately 1/16 inch larger than the desired periphery. As either cutter passes over a vacuum aperture, the adjacent cutter is in contact against the support surface, thereby cutting the material in the local region.

The controller guides the cutting assembly 60 so that the parallel cutters remain tangent to any radius of curvature. That is, the axis of rotation of the wheels is perpendicular to the cut path.

Once the periphery of the cut pieces is traced by the inner cutter, an operator may remove the cut piece from the remaining fabric, whereby any bridges of material that exist where the inside blade passed over an aperture and failed to completely severe the material only has a dimension of approximately 1/6 inch and is easily fractured during the weeding process.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. A method of cutting a sheet material along a line, comprising:

(a) retaining a portion of the sheet material on a support surface by creating a pressure differential across the sheet material by drawing air through a plurality of apertures in the support surface;

(b) cutting the sheet material along the line with a first cutting wheel and a second wheel;

(c) passing the first cutting wheel over an aperture; and (d) cutting the sheet material with the second cutting wheel along a path spaced from the line by a distance selected to ensure cutting the sheet material with the second cutting wheel adjacent the aperture.

2. A method of cutting a line in a sheet material spread upon a support surface having a plurality of apertures, wherein the line intersects an aperture, comprising:

(a) translating a first cutter and a second cutter spaced from the first cutter by a distance greater than a width of the aperture along the line to pass the first cutter over the aperture; and (b) passing the second cutter over the support surface adjacent the aperture.

3. A method of cutting a first line segment and a second line segment intersecting at a common apex in a sheet material on a support surface, comprising:

(a) translating a parallel cutter having a first cutting wheel and a second parallel cutting wheel in cutting engagement with the support surface; and (b) intersecting a cut line of the first cutting wheel in the first line segment with a cut line of the first cutting wheel in the second line segment and a cut line of the second cutting wheel in the second line segment, and intersecting a cut line of the second cutting wheel in the first line segment with the cut line of the first cutting wheel in the second line segment and the cut line of the second cutting wheel in the second line segment.

4. The method of claim 3, further comprising overcutting the first line segment.

5. The method of claim 3, further comprising heel cutting the second line segment.

6. A method of cutting a sheet material along a first and a second intersecting path segment with a parallel first and second cutter, comprising:

(a) moving the first cutter along the first path segment;

(b) overcutting the first path segment by a first distance; and (c) heel cutting the second path segment by a second distance, the first and the second distances selected so that the cut formed by the first cutter along the first segment and the first distance intersects the cut formed by the first cutter along the second distance and the second segment, and the cut formed by the second cutter along the first segment and the first distance intersects the cut formed by the second cutter along the second distance and the second segment.

7. An apparatus for cutting a sheet material comprising:

(a) a support surface having a plurality of apertures that interfere with the cutting, (b) a cutting assembly having first and second cutters spaced apart by a distance such that only one cutter can pass over an aperture at a time; and (c) a controller for moving the cutting assembly over the support surface, including the apertures so that at most, only one cutter is positioned over an aperture at any time.

8. The apparatus of claim 1, further comprising:

(a) a vacuum generator fluidly connected to the apertures for locally reducing a pressure in the apertures to below atmospheric pressure.

9. The apparatus of claim 7, wherein the cutters are spaced apart by a distance greater than approximately 50% of a maximum aperture dimension.

10. The apparatus of claim 7, wherein the cutters are spaced apart by a distance between approximately 80% and 110% of a maximum aperture dimension.

11. The apparatus of claim 7, wherein the cutters are spaced apart by a distance substantially equal to a maximum aperture dimension.

12. The apparatus of claim 1, wherein the cutters are parallel and the controller moves a first of the parallel cutters along a cut path passing over an aperture, the parallel cutters spaced apart by a distance sufficient to ensure a second of the cutters in cutting engagement with the support surface as the first cutter passes over the aperture.

13. The apparatus of claim 7, wherein the cutters have a pair of peripheral cutting edges spaced apart by a distance greater than an aperture dimension and less than an inter aperture distance.

14. An apparatus for cutting a sheet material, comprising:

(a) a pair of spaced apart parallel cutting wheels for cutting the sheet material;

(b) a support surface having a plurality of spaced apart apertures, the apertures interfering with cutting of the sheet material as a cutting wheel passes over an aperture; and (c) a controller operably connected to the cutting wheels for directing the cutting wheels relative to the support surface and translating a first one of the cutting wheels over a first aperture;

the parallel cutting wheels spaced apart by a distance so that the second one of the cutting wheels passes over the support surface while the first cutting wheel passes over the first aperture.

15. The apparatus of claim 14, wherein the distance between the cutting wheels is less than an inter aperture distance.

16. The apparatus of claim 14, wherein the distance between the cutting wheels is greater than 70 percent of a maximum aperture dimension and less than an inter aperture distance.

* * * * *